US008682205B2

(12) United States Patent
Iijima et al.

(10) Patent No.: US 8,682,205 B2
(45) Date of Patent: Mar. 25, 2014

(54) COOLING DEVICE, COOLING METHOD, AND IMAGE FORMING APPARATUS

(75) Inventors: Yasuaki Iijima, Kanagawa (JP); Satoshi Okano, Kanagawa (JP); Tomoyasu Hirasawa, Kanagawa (JP); Masanori Saitoh, Tokyo (JP); Shingo Suzuki, Kanagawa (JP); Keisuke Ikeda, Kanagawa (JP); Kenichi Takehara, Kanagawa (JP); Hiromitsu Fujiya, Kanagawa (JP); Keisuke Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 176 days.

(21) Appl. No.: 13/232,615

(22) Filed: Sep. 14, 2011

(65) Prior Publication Data

US 2012/0070180 A1 Mar. 22, 2012

(30) Foreign Application Priority Data

Sep. 16, 2010 (JP) ..... 2010-208426
Jun. 8, 2011 (JP) ..... 2011-128502

(51) Int. Cl.
*G03G 21/20* (2006.01)

(52) U.S. Cl.
USPC ..... 399/94

(58) Field of Classification Search
USPC ..... 399/44, 92, 94; 165/287, 104.28, 165/104.31
See application file for complete search history.

(56) References Cited

U.S. PATENT DOCUMENTS

| | | | |
|---|---|---|---|
| 6,087,028 | A | 7/2000 | Goto |
| 2009/0269099 | A1 | 10/2009 | Takehara |
| 2010/0008694 | A1 | 1/2010 | Okano et al. |
| 2010/0008695 | A1 | 1/2010 | Okano et al. |
| 2010/0129107 | A1 | 5/2010 | Takehara et al. |
| 2010/0183323 | A1 | 7/2010 | Fujiya et al. |

(Continued)

FOREIGN PATENT DOCUMENTS

| | | |
|---|---|---|
| JP | 2002-318517 | 10/2002 |
| JP | 2005-266249 | 9/2005 |

(Continued)

OTHER PUBLICATIONS

Chinese Office Action issued Jan. 16, 2013, in China Patent Application No. 201110264410.3.

*Primary Examiner* — Robert Beatty
(74) *Attorney, Agent, or Firm* — Oblon, Spivak, McClelland, Maier & Neustadt, L.L.P.

(57) ABSTRACT

A cooling device to cool an apparatus includes a heat receiver to receive heat from a hot portion of the apparatus using a coolant while contacting the hot portion, a heat releaser to cool the heat-received coolant to release the heat from the hot portion to outside the apparatus, the heat releaser having a variable-speed fan of multiple operation speed modes including an off mode, a coolant circulation system through which the coolant is circulated between the heat receiver and the heat releaser, a variable-speed pump to move the coolant through the coolant circulation system, whose operation speed modes include an off mode and relate to a coolant flow rate of the pump, a temperature sensor to detect a temperature in the hot portion, and a controller to control the operation modes of the fan and the pump in accordance with the temperature detected by the temperature sensor.

12 Claims, 9 Drawing Sheets

(56) References Cited

U.S. PATENT DOCUMENTS

| | | | |
|---|---|---|---|
| 2011/0030927 | A1 | 2/2011 | Okano et al. |
| 2011/0052247 | A1 | 3/2011 | Saitoh et al. |
| 2011/0052248 | A1 | 3/2011 | Nishimura et al. |
| 2011/0052249 | A1 | 3/2011 | Iijima et al. |
| 2011/0164896 | A1 | 7/2011 | Hirasawa et al. |
| 2011/0170895 | A1 | 7/2011 | Fujiya et al. |
| 2011/0188880 | A1 | 8/2011 | Suzuki et al. |

FOREIGN PATENT DOCUMENTS

| | | | | |
|---|---|---|---|---|
| JP | 2006-3383 | | | 1/2006 |
| JP | 2007-24985 | | | 2/2007 |
| JP | 2008064901 | A | * | 3/2008 |
| JP | 2009169276 | A | * | 7/2009 |
| JP | 2009-300852 | | | 12/2009 |
| JP | 2009300852 | A | * | 12/2009 |

* cited by examiner

COOLING DEVICE, COOLING METHOD, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2010-208426, filed on Sep. 16, 2010, and 2011-128502, filed on Jun. 8, 2011 in the Japan Patent Office, the entire disclosure of which are hereby incorporated herein by reference.

BACKGROUND OF THE INVENTION

1. Field of the Invention

The present invention relates to a cooling device, a cooling method employing the cooling device, and an image forming apparatus, such as a copier, a printer, a facsimile machine, a plotter, or a multifunction machine capable of at least two of these functions, incorporating the cooling device.

2. Description of the Background Art

In general, electrophotographic image forming apparatuses, such as copiers, printers, facsimile machines, and multifunction devices including at least two of those functions, etc., include an optical writing device (exposure device) to direct writing light onto an image carrier so as to form an electrostatic latent image thereon, a development device to develop the latent image with developer, a transfer unit to transfer the developed image (toner image) onto a sheet of recording media, and a fixing device to fix the toner image on the sheet.

It is known that, in typical image forming apparatuses, devices such as the optical writing device, the fixing device, the development device, and a drive motor that drives the image carrier generate heat.

In recent years, as electrophotographic image forming apparatuses, there is market demand for multicolor image forming apparatuses, such as multicolor multifunction machines and multicolor printers. Some multicolor image forming apparatuses are so-called single-drum type image forming apparatuses in which multiple development devices for corresponding colors are provided around a single photoreceptor. In this single-drum type, toner images are formed on the photoreceptor by adhering the toner in the development devices, and the toner images on the photoconductor are transferred onto a sheet as a color image. Other multicolor image forming apparatuses are so-called tandem-drum type image forming apparatus in which multiple development devices for corresponding colors are provided around multiple respective photoreceptors. In this tandem-drum type, a single toner image is formed on each of the photoreceptor, and the single-color toner images on the respective photoconductors are subsequently transferred onto the sheet as a color image.

Comparing single-drum type and the tandem-drum type, in the single-drum type image forming apparatus, the image forming apparatus includes the single photoreceptor, which can be made more compact, thereby reducing cost. However, a full color (multiple color) image is formed by forming images several times (four or five times) using the single photoreceptor, which hinders an increase in image formation speed (printing speed). By contrast, in the tandem-drum type image forming apparatus, although the image forming apparatus is bulky and is relatively costly, it facilitates faster printing speeds. Therefore, at present, to improve productivity, it is desired to increase full-color printing speed to levels like those of monochrome printing, and for this reason tandem-drum type image forming apparatuses have been drawing attention.

Some tandem-drum type multicolor image forming apparatuses are direct-transfer types (see FIG. 1), in which toner images on photoreceptors 211 in photoreceptor units 210 are subsequently transferred onto a sheet P that is conveyed by a sheet conveyance belt 250 and respective transfer members 251. Others are indirect-transfer types (see FIG. 2), in which images on the photoreceptors 211 in the photoreceptor units 210 are subsequently transferred onto an intermediate transfer belt 260 by primary transfer members 261, after which the images on the intermediate transfer belt 260 are transferred onto a sheet P all at once by a secondary transfer device 270, which may be either a roller or a belt. In some indirect-transfer types, the intermediate transfer belt 260 may be disposed above the respective photoreceptor units 210 as illustrated in FIG. 3.

In the indirect-transfer tandem-drum-type image forming apparatus shown in FIG. 2, to make the image forming apparatus compact, in addition to packing components densely in the image forming apparatus, a fixing device 280 is disposed beneath the photoreceptor units 210 and adjacent to the respective photoreceptor unit 210. However, the fixing device 280 generates heat that can affect the temperatures of the photoreceptor units 210.

At present, due to increasing demand for increase in the printing speed, more compact image forming apparatus, and higher image quality, the temperature increase in the respective photoreceptor unit (image forming unit) becomes an issue not only in the indirect-transfer-drum type image forming apparatuses but also in all image forming apparatuses. In addition, packing components densely in the electrophotographic image forming apparatus increases the amount of heat generated. Accordingly, failure, for example the toner used to develop images might congeal, may occur in the respective hot photoreceptor units.

In order to solve the above-described problem, such image forming apparatuses typically include forced-air-cooling devices in which air flows through a small area formed by a heat conductor provided in the development device and forcibly cools the development device. However, toner with a lower melting point has come to be widely used in the image forming apparatus to improve image quality and enhance performance. Therefore, it becomes difficult to secure sufficient cooling ability by air cooling.

In view of the foregoing, liquid-cooling devices have been proposed for cooling the devices in the image forming apparatus. In general, the cooling efficiency of liquid-cooling devices is higher than that of typical air-cooling devices. However, cooling is performed even when the ambient temperature is low and cooling is not necessary. In addition, since the image forming unit includes a cleaning blade in a cleaning device for clean a photoreceptor, a cleaning failure may occur when the cleaning blade is cooled too much.

Other known image forming apparatuses uses a liquid-cooling device that includes multiple heat receiving portions corresponding to image forming units (hot portions), multiple heat releasers (cooling members) corresponding to at least one image forming unit, a cooling tube through which coolant is circulated, a conveyance device to convey the coolant, and a controller. However, even with such a configuration, the problem of cleaning failure caused by excessive cooling remains unresolved.

SUMMARY OF THE INVENTION

The present invention provides an improved cooling device capable of optimizing cooling performance and efficiency by executing the minimum necessary cooling needed for any given amount of heat generated while eliminating energy expenditure for unnecessary cooling, as well as alleviating cooling fan driving noise.

In one exemplary embodiment of the present invention, a cooling device to cool an apparatus includes a heat receiver, a heat releaser having a variable-speed fan, a coolant circulation system, a variable-speed pump, a temperature sensor, and a controller. The heat receiver receives heat from a hot portion of the apparatus using a coolant while contacting the hot portion of the apparatus. The heat releaser cools the heat-received coolant to release the heat from the hot portion of the apparatus to outside the apparatus and has the variable-speed fan of multiple operation speed modes including an off mode. The coolant circulation system connects the heat receiver and the heat releaser, and the coolant is circulated between the heat receiver and the heat releaser through the coolant circulation system. The variable-speed pump moves the coolant through the coolant circulation system, whose operation speed modes include an off mode and relate to a coolant flow rate of the pump. The temperature sensor detects a temperature in the hot portion. The controller controls the operation modes of the fan and the pump in accordance with the temperature detected by the temperature sensor.

In another exemplary embodiment of the present invention, there is provided a cooling method used in the above-described cooling device. The cooling method includes contacting a heat receiver with an external hot portion, receiving heat by the heat receiver from the hot portion using a coolant, detecting a temperature in the hot portion with a temperature sensor, pumping the coolant from the heat receiver through a coolant circulation system to a variable-speed pump, switching a speed of the pump in accordance with the temperature detected by the temperature sensor, pumping the coolant from the pump through the coolant circulation system to the heat releaser, switching a speed of a variable speed fan in the heat releaser in accordance with the temperature detected by the temperature sensor, cooling the coolant by the heat releaser, pumping the cooled coolant from the heat releaser through the coolant circulation system to the heat receiver, and releasing the heat from the hot portion to outside the cooling device using the cooled coolant.

In yet another exemplary embodiment of the present invention, an image forming apparatus includes a latent image carrier to carry a latent image, a development device to develop the latent image formed on the latent image carrier with developer, a cooling device to cool the development device, and a controller. The cooling device includes the above-described heat receiver, the heat releaser having the variable-speed fan, the coolant circulation system, the variable-speed pump, and the temperature sensor. The controller controls the operation modes of the fan and the pump in the cooling device in accordance with the temperature detected by the temperature sensor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
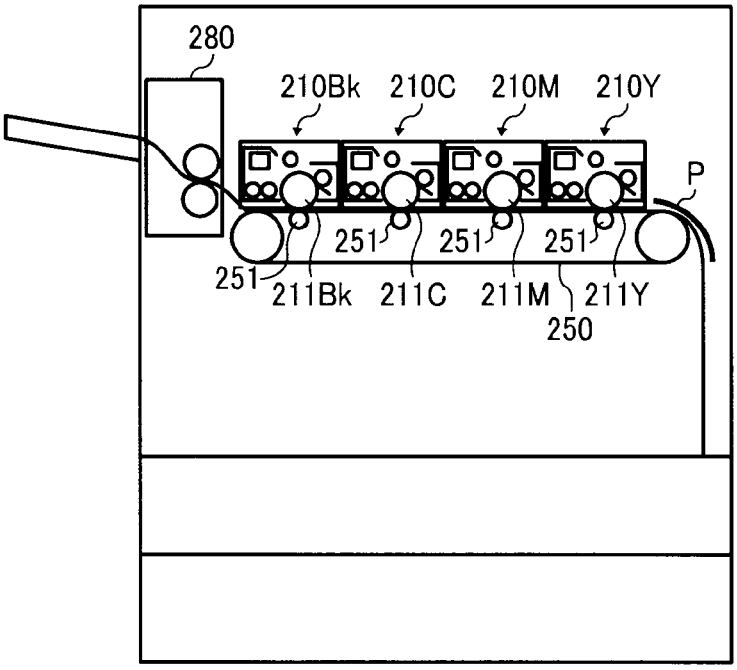
FIG. 1 PRIOR ART
FIG. 1 is a pattern diagram illustrating a related-art direct-transfer tandem-drum type image forming apparatus.
Figure 2:
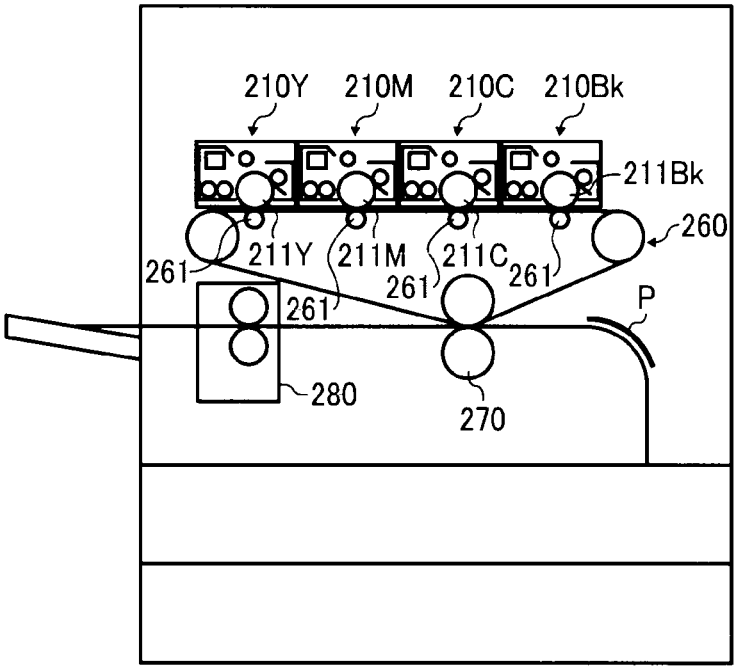
FIG. 2 PRIOR ART
FIG. 2 is a pattern diagram illustrating a related-art indirect-transfer tandem-drum type image forming apparatus in which photoreceptor units are disposed above an intermediate transfer belt.
Figure 3:
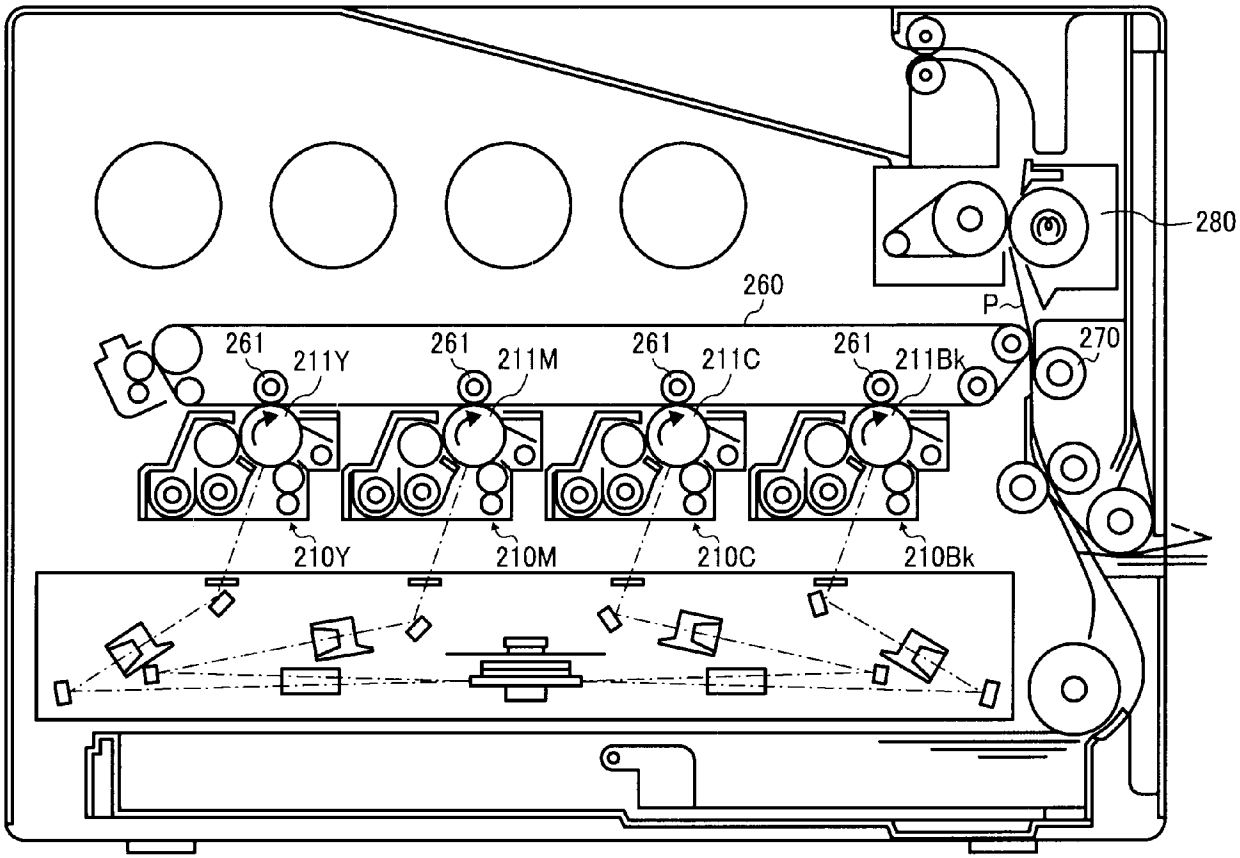
FIG. 3 PRIOR ART
FIG. 3 is a pattern diagram illustrating another related-art indirect-transfer tandem-drum type image forming apparatus in which photoreceptor units are disposed beneath an intermediate transfer belt.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 4:
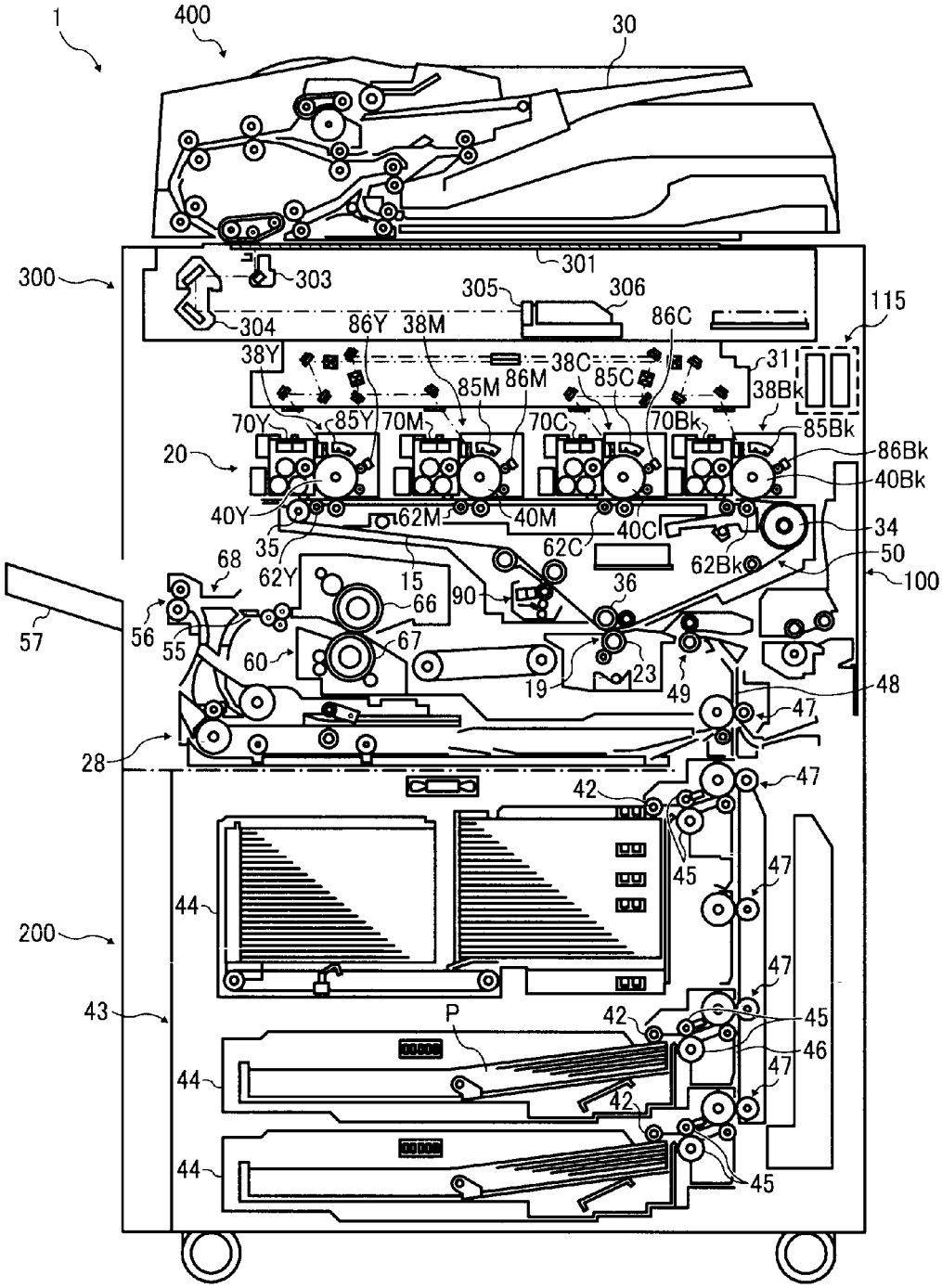
FIG. 4 is an schematic diagram illustrating an entire configuration of an image forming apparatus including a cooling device according to exemplary embodiments of this disclosure.

Referring now to the drawings, wherein like reference numerals designate identical or corresponding parts throughout the several views thereof, and particularly to FIG. 4, an image forming apparatus 1 that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

The image forming apparatus 1 mainly includes a image forming section 100 that is a main body of the image forming apparatus 1 to form images, a feed-paper table 200 on which the image forming section 100 is placed, a scanner 300 provided above the image forming section 100, and an automatic document feeder (ADF) 400 attached on the scanner 300.

The ADF 400 includes a document table 30 and automatically feeds documents to a position where a document is scanned. The scanner 300 includes a contact glass 301, a first carriage 303 installing a light source for lighting documents and a mirror, a second carriage 304 installing multiple reflection mirrors, an image focusing lens 305, and a reading sensor 306 disposed at a downstream position from the image focusing lens 305 in which a light from the light source travels. The scanner 300 scans image data on a document placed on the contact glass 301 while the second carriage 304 reciprocally moves. At this time, the scanning light emitted from the second carriage 304 is focused on a focusing face of the reading sensor 306 by the image focusing lens 305 and then is read by the reading sensor 306 as an image signal.

The image forming section 100 includes four photoreceptor drums 40Y, 40M, 40C, and 40Bk as latent image carriers corresponding yellow (Y), magenta (M), cyan (C), and black (Bk) color toners. On the photoreceptor drum 40, a development device 70, a charging device 85, a photoreceptor cleaning member 86, functioning as components for executing electrophotographic process, are provided. These components constitute image forming unit 38Y, 38M, 38C, and 38Bk. The image forming unit 38 is removably installed in the image forming section 100 (main body of the image forming apparatus 1), and consumables can be exchanged at once. The four image forming units 38 are arranged in parallel, which form a tandem-drum type image forming station (hereinafter just "tandem image forming station") 20. It is to be noted that the suffixes Y, M, C, and Bk indicate only that components indicated thereby are used for forming yellow, magenta, cyan, and black images, respectively, and hereinafter may be omitted when color discrimination is not necessary.

The development device 70 in the image forming units 38 contains developer containing respective four color toners. The development device 70 includes a development roller 71 as a developer bearer (see FIGS. 7A and 7B). The development roller 71 bears and carries the developer to a development region facing the photoreceptor drum 40, and develops an electrostatic latent image on the photoreceptor drum 40 with the toner into the toner image thereon in the development region.

Figure 5A:
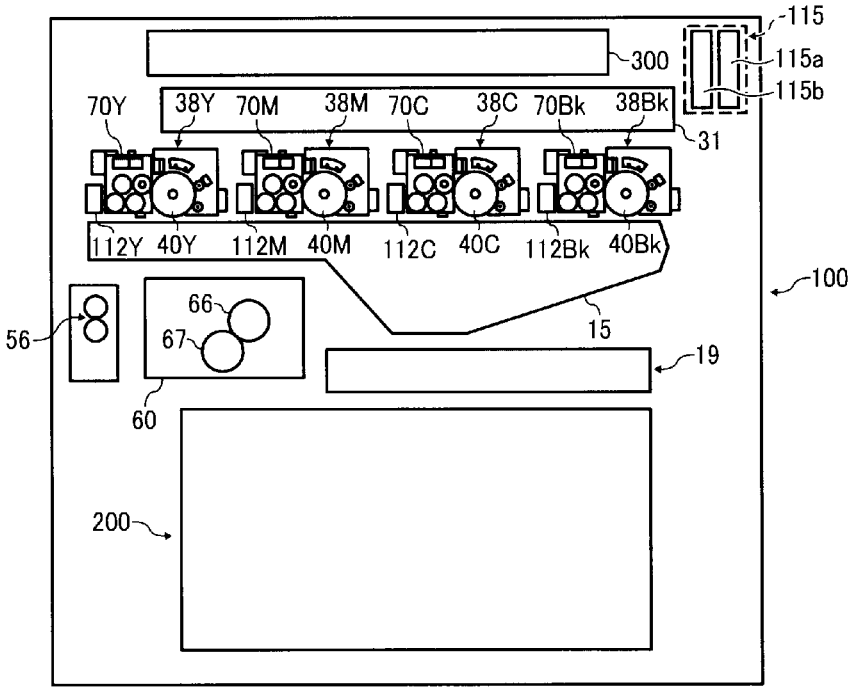
FIG. 5A is a pattern diagram illustrating the image forming apparatus shown in FIG. 4.
Figure 5B:
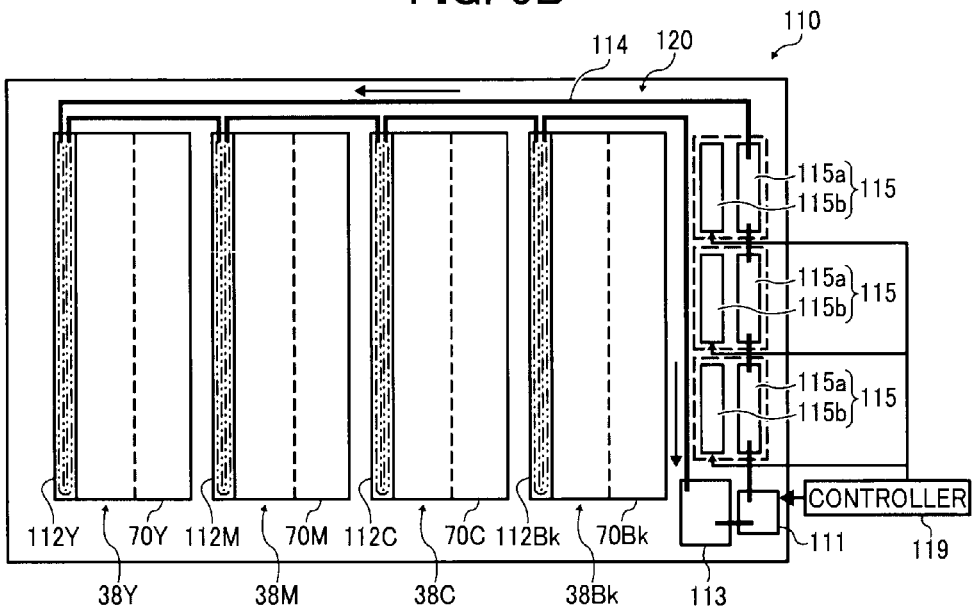
FIG. 5B is a pattern diagram illustrating arrangement of the cooling device shown in FIG. 4, a coolant circulation system thereof, and a image forming unit when viewed from above.
Figure 6:
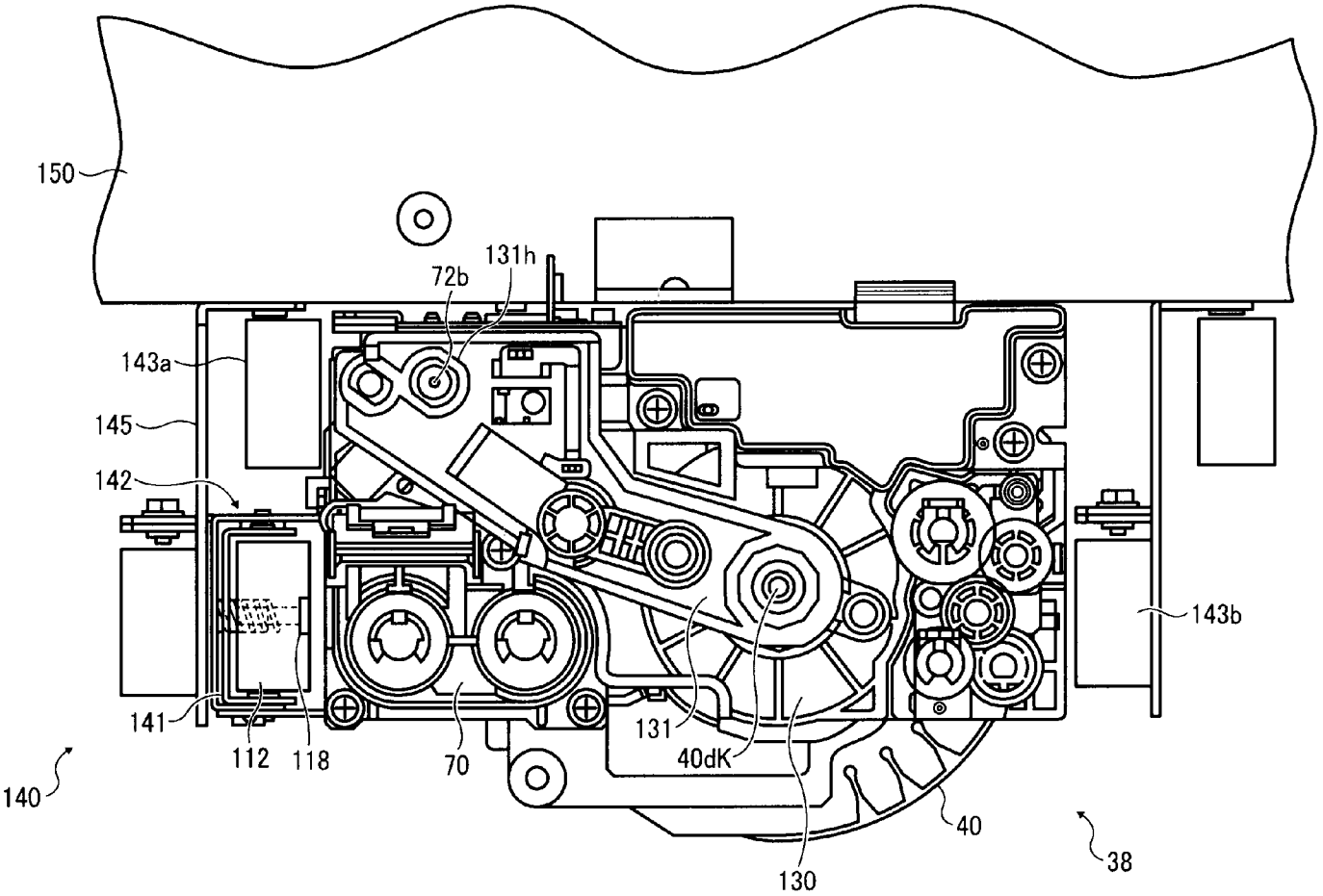
FIG. 6 is an end-on cross-sectional diagram illustrating a front end of vicinity of the image forming unit in the image forming apparatus shown in FIG. 5B.

Herein, a configuration of the image forming unit 38 and the cooling device 110 in the image forming section 100 is described below with reference to FIGS. 5A through FIG. 7B. FIG. 5A is a pattern diagram illustrating the image forming apparatus 1. FIG. 5B is a pattern diagram illustrating arrangement of the cooling device 110, a coolant circulation system thereof, and the image forming unit 38 when viewed from above. FIG. 6 is an end-on cross-sectional diagram illustrating a front end of vicinity of the image forming unit 38 in the image forming section 100 of the image forming apparatus 1. As illustrated in FIG. 6, the image forming unit 38 is supported by extendable rails 143*a* and 143*b* (for example, rail manufactured by accuride) provided in the image forming section 100. The image forming unit 38 is pushed into the image forming section 100 while a drum shaft 40*dk* and the rails 143*a* and 143*b* are inserted into the image forming unit 38, thus installing the image forming unit 38 in the image forming section 100.

A contact-separation device 140 that contacts and separates a heat receiver 112 of the cooling device 110 with and from the development device 70 is disposed close to each development device 70. The contact-separation device 140 includes a holder 141 to retain the heat receiver 112 and a supporter 142 to support the holder 141 so that the heat receiver 112 can contact and separate from the development device 70. A spring attached to the holder 141 presses the heat receiver 112 to a sidewall of the development device 70. The supporter 142 is fixed to a stationary plate 145 to which the rail 143*a* is attached (left side in FIG. 6). The stationary plate 145 is fixed to a partition 150, and a writing area in which an exposure device 31 is provided and the tandem image forming station 20 including the four image forming unit 38 are separated by the partition 150. In the contact-separation device 140, the holder 141 covers a face opposite to the pressing face, an upper face, and a lower face of the heat receiver 112. By covering the heat receiver 112 with the holder 141, an infrared light from a fixing device 60 can be shielded, which prevents the heat receiver 112 from being thermally affected from other than the development device 70. Thus, heating the heat receiver 112 by being thermally affected from other than the development device 70 can be inhibited, and therefore, the development device 70 can be effectively cooled.

Figure 7A:
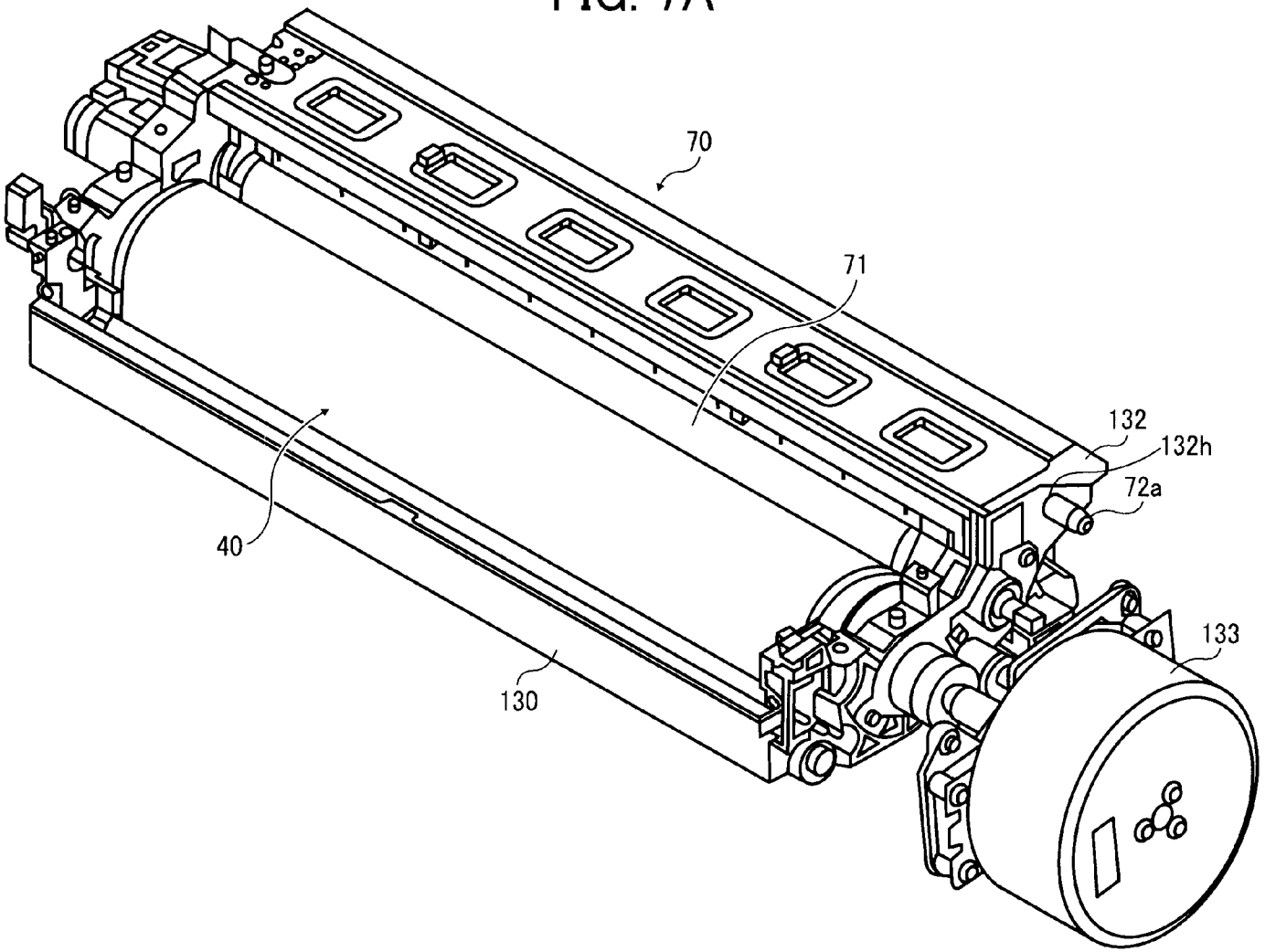
FIG. 7A is a perspective diagram illustrating the image forming unit shown in FIG. 5B when viewed from back side.
Figure 7B:
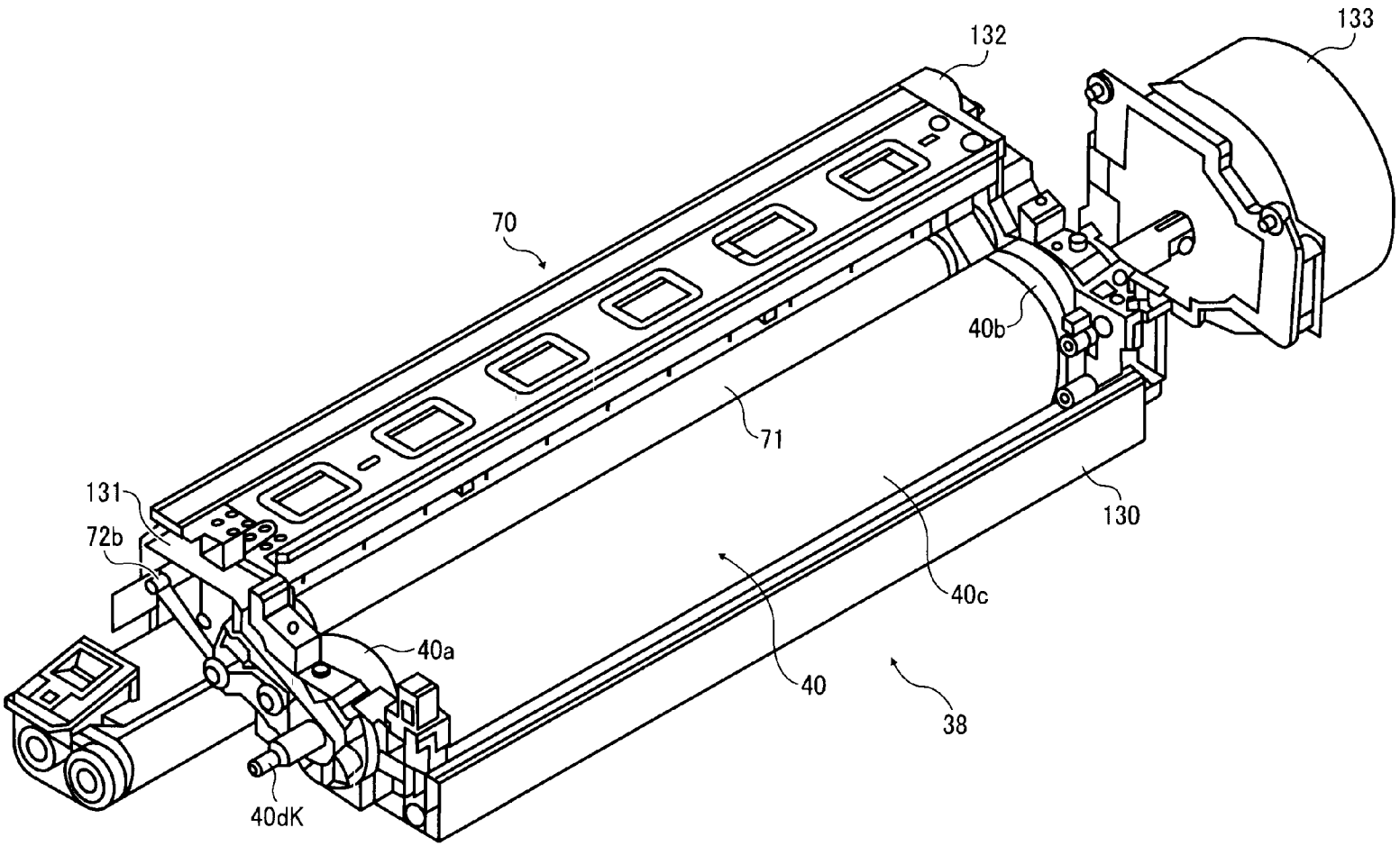
FIG. 7B is a perspective diagram illustrating the image forming unit shown in FIG. 5B when viewed from front side.

FIG. 7A is a perspective diagram illustrating the image forming unit 38 when viewed from backside, and FIG. 7B is a perspective diagram illustrating the image forming unit 38 when viewed from front side. The photoreceptor drum 40 is formed by a photoreceptor roller 40*c* on which a photosensitive layer is coated, a front flange 40*a*, and a back flange 40*b*. The front flange 40*a* and the back flange 40*b* of the photoreceptor drum 40 are rotatably supported by a frame 130 of the image forming unit 38.

In installation of the development device 70 in the image forming unit 38, initially the development device 70 is temporarily positioned to the frame 130 of the image forming unit 38 (main positioning process), and then the development device 70 is positioned by a front positioning blade 131 and a back positioning blade 132 serving as positioning members (sub positioning process). Both positioning blades 131 and 132 rotatably support the drum shaft 40*dk*, functioning as a support shaft, of the photoreceptor drum 40 and a development-roller shaft of the development roller 71 provided in the development device 70 so that a development gap is present between the photoreceptor drum 40 and the development roller 71. The drum shaft 40*dk* of the photoreceptor drum 40 is rotatably engaged with the positioning blades 131 and 132 via bearings. The development-roller shaft of the development roller 71 is also rotatably engaged with the positioning blades 131 and 132 via bearings. A back reference hole 132*h* is formed in the back positioning blade 132, and a reference pin 72*a* fixed to the development device 70 is fitted into the back reference hole 132*h*. Similarly, a front reference hole 131*h* (see FIG. 6) is formed in the front positioning blade 131, and a front reference pin 72*b* fixed to the development device 70 is fitted into the reference hole 131*h*. Thus, the reference pins 72*a* and 72*b* are fitted in the reference holes 131*h* and 132*h* in the respective the positioning blades 131 and 132, which inhibits the development device 70 from rotating around the development-roller shaft (center shaft) of the development roller 71.

When the above-configured image forming unit 38 is attached to an operation position of the image forming unit 100, the drum shaft 40*dk*extending from a photoreceptor motor 133 penetrates through the photoreceptor drum 40 and then is fitted into the bearings in the respective positioning blades 131 and 132. Thus, the position of the photoreceptor drum 40 is determined, and a distance between a center axis of the photoreceptor drum 40 and that of the development roller 71 is appropriately restricted. With this configuration, a slight gap between the photoreceptor drum 40 and the development roller 71 can be reliably kept, and therefore, high-quality toner image can be developed on the photoreceptor drum 40. Herein, it is preferable that the positioning blades 131 and 132 be formed of a resin from a viewpoint of cost reduction and weight reduction, however, the positioning blades 131 and 132 may formed of metal material.

Referring back to FIG. 4, a configuration of the image forming section 100 in the image forming apparatus 1 is described below. The image forming section 100 mainly includes the tandem image forming station 20, the exposure unit 31 disposed above the tandem image forming station 20, an intermediate transfer unit 50 including an intermediate transfer belt 15 disposed beneath the tandem image forming station 20, a secondary transfer device 19 disposed beneath the intermediate transfer unit 50, and the fixing device 60.

The exposure unit 31 serving as a latent image forming device includes multiple lasers or multiple light emitting diodes (LED). The lasers or LED in the exposure unit 31 emit light to the respective photoreceptor drum 40 in accordance with the image data from the scanner 300, thus forming a latent image on respective surfaces of the photoreceptor drum 40 in an exposure process.

In the intermediate transfer unit 50, the intermediate transfer belt 15 formed by an endless belt is disposed beneath the tandem image forming station 20 facing the photoreceptor drums 40. The intermediate transfer belt 15 is looped around multiple support rollers 34 and 35 and a secondary-transfer backup roller 36. Four primary transfer members 62 are disposed facing the photoreceptor drums 40 via the intermediate transfer belt 15 and transfer the respective colors of the toner images onto the intermediate transfer belt 15 in a primary transfer process.

In the secondary transfer device 19, the respective single-color toner images that are superimposed one on another on the intermediate transfer belt 15 are transferred onto the sheet P fed from a sheet cassette 44 in the feed table 200 at once. The secondary transfer device 19 includes a secondary transfer roller 23 and a contact-separation mechanism that supports the secondary transfer roller 23 to contact and separate from the intermediate transfer belt 15. In the secondary transfer device 19, the secondary transfer roller 23 presses against the secondary-transfer backup roller 36 via the intermediate transfer belt 15, thus transferring multicolor toner images in which single color toner images are superimposed one on another on the intermediate transfer belt 15 onto the sheet P in a secondary transfer process.

A belt cleaning unit 90 that removes the residual toner on the surface of the intermediate transfer belt 15 is provided adjacent to the intermediate transfer belt 15. In the belt cleaning unit 90, a belt cleaning blade formed of, for example, far brush or urethane rubber, contacts the intermediate transfer belt 15 and scrapes off the residual toner adhering to the intermediate transfer belt 15 after the secondary transfer process.

The fixing device 60 is provided adjacent to the secondary transfer device 19, which fixes the image on the sheet P. The fixing device 60 includes a heating roller 66 including a heater as a heat source and a pressure roller 67 to be pressed by the heating roller 66.

A reverse mechanism 28 that reverses the sheet P is provided beneath the secondary transfer device 19 and the fixing device 60. The reverse mechanism 28 reverses the sheet P and again sends the sheet P to the secondary transfer device 19 to print the images on both side of the sheet P (duplex printing).

The configuration of the feed table 200 is described as follows: The feed table 200 includes a paper bank 43 including multistage of sheet cassettes 44, feed rollers 42 and separation roller pairs 45 provided in the respective sheet cassettes 44, and multiple transport roller pairs 47. A guide path 46 through which the sheet P is transported to a feed path 48 in the image forming section 100 is formed in the feed table 200.

Next, a copying operation using the above-described image forming apparatus 1 is described below with reference to FIG. 4. As sheet feeding modes, the image forming apparatus 1 has a normal mode and a manual feeding mode. When a user makes copies of a document using the image forming apparatus 1, initially, in the normal mode, the user sets the document on the document table 30 of the ADF 4. Alternatively, in the manual feeding mode, the user opens the ADF 4, sets the document on the contact glass 301 of the scanner 300 disposed beneath the ADF 4, and then presses the document with the contact glass 301 by closing the ADF 4. Subsequently, when a start switch (not shown) is pushed, in the normal mode, the document is conveyed automatically to the contact glass 301, and then the scanner 300 is activated. Alternatively, in the manual feeding mode, the scanner 300 is immediately activated after the start switch is pushed. When the scanner 300 is activated, the first carriage 303 and the second carriage 304 begin moving. Therefore, the light source in the first carriage 303 emits laser light onto the document, and the mirror in the first carriage 303 receives a reflection light from the document and reflects the received light to the second carriage 304. Then, the pair of mirrors in the second carriage 304 further reflects the light to the image focusing lens 305. Then, the ray of light passes though the image focusing lens 305 and enters the reading sensor 306, and the contents of the document are read by the reading sensor 306.

In addition, when the start switch is pushed, a driving motor activates one of the support rollers 34 and 35 and the secondary-transfer backup roller 36, and other rollers are rotated dependently, thus rotating the intermediate transfer belt 15.

Along with these processes, in the image forming unit 38, the charging device 85 uniformly charges the photoreceptor drum 40. Then, the exposure device 31 irradiates the respective photoreceptor drums 40 with the respective laser beams or LED light in accordance with the image data from the scanner 300, thus forming latent images on the charged surface of the respective photoreceptor drums 40. Subsequently, the development device 70 supplies the toner to the photoreceptor drum 40 to visualize the latent image, thus forming yellow, magenta, cyan, and black of single-color toner images on the photoreceptor drums 40 respectively. After that, the primary transfer members 62 primary transfers the toner image on the photoreceptor drum 40 onto the intermediate transfer belt 15 so that four toner image are superimposed one on another on the surface of intermediate transfer belt 15. After the primary transfer process, residual toner in the surface of the photoconductor drums 40 is removed by the photoreceptor cleaning device 86, and then electrically discharged by a discharge device, as preparation for the subsequent image formation.

In addition, along with these processes, when the start switch is pushed, one of the feed rollers 42 in the feed table 200 sends out the sheet P from one of multistage of the sheet cassettes 44 provided in the paper bank 43. The separation roller 45 separates the sheet P one-by one and guides the guide path 46. Then, the transport roller pair 47 guides the sheet P to the feed path 48 in the image forming section 100, and the pair of registration rollers 49 stops conveying the sheet P from the feed path 48. The registration rollers 49 forward the sheet P to a portion between the intermediate transfer belt 15 and the secondary transfer device 19, timed to coincide with the arrival of the multicolor toner image formed on the intermediate transfer belt 15.

The sheet P onto which multicolor image is transferred in the secondary transfer roller 23 is transported to the fixing device 60, where the four-color toner image thus transferred is fixed on the surface of the transfer sheet P with heat and pressure in a fixing process. After the fixing process, by switching a switch pawl 55, the sheets P are discharged toward a discharge sheet tray 57 located outside of the image forming apparatus 1 through a discharge path 68 by a pair of discharging sheet rollers 56 and are stacked on the discharge sheet tray 57. Alternatively, when duplex printing to record images on both sides of the sheet is selected, after the image is formed on one side of the sheet P, the sheet P is fed to the sheet reverse mechanism 28 by switching the switch pawl 55. The sheet P thus reversed is conveyed to a position facing the secondary transfer member 23 to form an image on the other side of the sheet P, and then the sheet P is discharged to the discharge tray 57 by the discharge rollers 56. After the secondary transfer process, the intermediate transfer belt 15 reaches a position facing the belt cleaning unit 90, where any toner remaining on the intermediate transfer belt 15 is collected by the belt cleaning unit 90, as preparation for subsequent image formation.

Herein, in the above-configured image forming apparatus 1, when the above-described image forming operation keeps for a long time, due to generate heat in the photoreceptor drum 40 and the development roller 41 functioning as rotary members, and by providing and receiving the heat from the fixing device 60, the temperature in the image forming unit 38 may be increased. At this time, an interior temperature in the development device 70 of the image forming unit 38 is increased, and therefore, the toner in the development device 70 may be melt and fixed, which may cause the development device 70 to stop and be broken.

Accordingly, it is necessary to set the temperature of the development device 70 to be lower than a melting temperature at which the toner is melted. Thus, in the embodiments of the present disclosure, the image forming apparatus 1 includes the cooling device 110 that is a cooling system in which the heat receiver (cooling jacket) 112 through which a coolant C flows is provided on the sidewall of the development device 70, and the temperature increase in the development device 70 is alleviated.

Configuration of Cooling Device

Next, a configuration of the cooling device is described below with reference to FIGS. 5A, 5B and 8. The cooling device 110 includes a pump 111, the heat receiver 112, a tank 113, a tube 114, and a heat releaser 115 including a radiator 115*a* and a cooling fan 115*b*. The four heat receivers (cooling jacket) 112Y, 112M, 112C, and 112Bk are provided so as to closely contact the sidewall of the development devices 70Y, 70M, 70C, and 70Bk that is a portion in which the temperature is increased (hot portion), the coolant C circulating in the heat receiver 112 draws heat from the development devices 70. The tube 114 forms a coolant circulation system 120 that annually connects the heat receivers 112Y, 112M, 112C, and 112Bk, the tank 113, the pump 111, and the radiator 115*a*. The coolant C is circulated in the coolant circulation system 120 by the pump 113 in the directions indicated by the arrows in FIG. 5B. More specifically, using the pump 111 as a starting point, the coolant C is circulated among the pump 111, the radiator 115*a*, the respective heat receivers 112, and the tank 113, in this order. Then, in the three heat releasers 115, the coolant C in the tube 114 heated in the respective heat receiver 112 is fed to the radiator 115*a* of the heat releaser 115, and the radiator 115*a* is cooled by releasing the heat to atmosphere by the cooling fan 115*b*.

Herein, each the respective tube 114 is formed of a flexible material such as rubber or resin. The heat receivers 112 are movably supported to the sidewall of the development device 70 by the contact-separation device 140 in the image forming unit 48. Accordingly, when the tube 114 is formed of the flexible material such as the rubber tube and the resin tube, the tube 114 can follow the movement of the heat receiver 112, thus preventing failure such as separating the tube 114 from the heat receiver 112. Not every portion of the tube 114 in the coolant circulation system 120 is formed of the flexible material, and thus the tube 114 may be partly formed of metal, which minimizes moisture permeability.

The pump 111 is a conveyance device to circulate the coolant C in the coolant circulation system 120 between the heat releaser 115 and the respective heat receiver 112. The tank 113 is used for storing the coolant C and is used for pouring the coolant C into the coolant circulation system 120. In the cooling device 110, the pump 111, the radiator 115*a*, the tank 113, and the heat receiver 112 are connected by the tube 114 and are fixed to the image forming section 100. In this state, the cooling device 110 waits for the image forming unit 38 to attach to the operation position of the image forming section 100.

The above-configured non-controlled liquid cooling device has better cooling ability than an air-cooling device. However, only configured above, the non-controlled liquid cooling device cools even when ambient environment is at a low temperature in a state in which it is not require for cooling. In addition, the image forming unit 38 includes a cleaning blade as a cleaning member for cleaning the photoreceptor drum 40, considering feature of the material of the cleaning blade, cleaning failure may occur when the cleaning blade is excessively cooled. In addition, only configured above, the pump 111 functioning as the conveyance device to convey the coolant C does not operate based on the temperature in the image forming unit, the driving noise and the driving cost may kept regardless of the temperature of the development device 70 in the image forming unit 38.

In order to solve this problem, in a first embodiment, the cooling device can switch to a cooling ability corresponding to a desired heating amount for releasing. Consequently, the cooling ability can be optimized and noise can be alleviated.

First Embodiment

Herein, a cooling device according to a first embodiment is described below with reference to FIGS. 6, 8, and 9. The cooling device 110 according to the first embodiment is only different from the above-described non-controlled cooling device is a point that, providing temperature sensors 118 that detect hot portions of the development devices 70Y, 70M, 70C, and 70Bk, and the cooling device 110 cools at a suitable operation mode by controlling the pump 111 and the cooling fan 115*b* in accordance with the detected temperature. Accordingly, description of a common configuration and operation are omitted below as appropriate.

Figure 8:
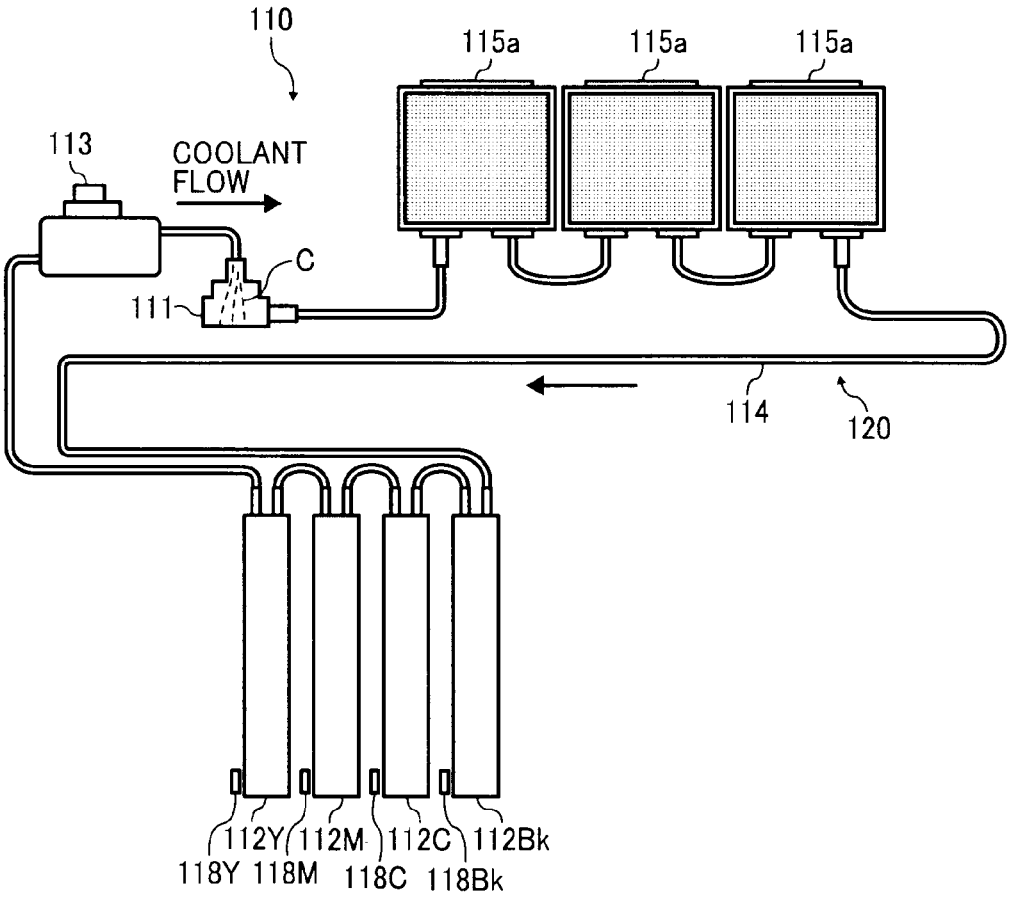
FIG. 8 is a diagram illustrating a configuration of the cooling device shown in FIG. 4.

As illustrated in FIGS. 6 and 8, the temperature sensors 118 are provided close to the heat receivers 112Y, 112M, 112C, and 112Bk that contact and separate from the sidewall of the development device 70, in the contact-separation device 140 of the respective image forming units 38. More specifically, as illustrated in FIG. 8, the temperature sensors 118Y, 118M, 118C, and 118Bk are provided in the corresponding heat receivers 112Y, 112M, 112C, and 112Bk that contact and separate from the sidewall of the development device 70. The temperature sensors 118 are protected by heat insulators positioned away from the tube 114 in the heat receiver 112 and are pressed to the sidewall of the development device 70 so that the temperature sensor 118 can detect the temperature in the sidewall (hot portion) in the development device 70, without being affected by the temperature of the coolant C flowing though the heat receiver 112.

Figure 9:
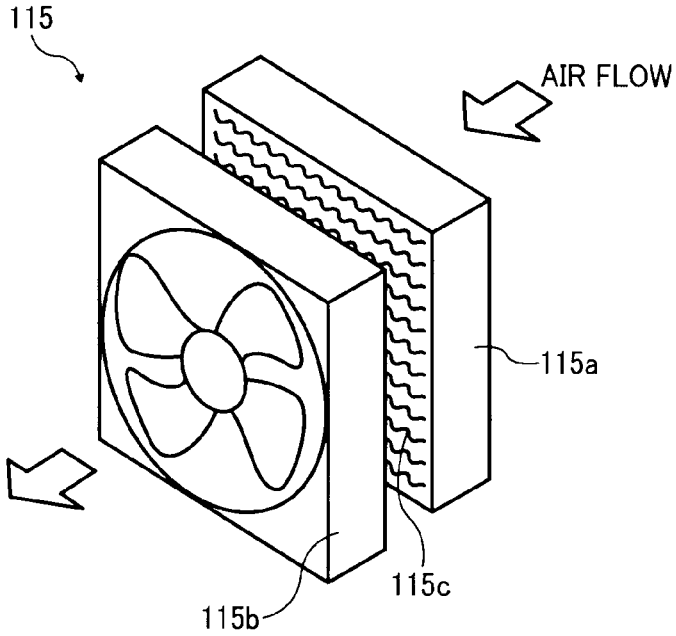
FIG. 9 is a diagram illustrating a heat releaser in the cooling device according to a first embodiment.

FIG. 9 is a diagram illustrating the heat releaser 115 in the cooling device 110 according to present embodiment. As illustrated in FIG. 9, the heat releaser 115 includes the radiator 115*a* and the cooling fan 115*b*. The cooling fan 115*b* takes in external air and the radiator 115*a* is cooled by the wind generated by the cooling fan 115*b*. Herein, it makes no difference whether the radiator 115*a* or the cooling fan 115*b* is positioned on the intake side or the exhaust side. The cooling fan 115*b* of the present embodiment is a variable-speed fan that can switch between multiple different operation modes (including off state). More specifically, the cooling fan 115*b* can switch speeds, that is, change the number of rotations per unit time in steps.

In addition, the pump 111 of the present embodiment is a variable-speed pump that can switch operation modes (including off state). More specifically, the pump 111 can switch speeds, that is, change a coolant flow rate per unit time in steps.

The cooling ability of the cooling device 110 is determined by controlling the operation modes of the cooling fan 115*b* of the heat releaser 115 and that of the pump 111. Thus, the cooling device 110 is configured to cool at a suitable mode by controlling the cooling fan 115*b* and the pump 111 in accordance with the temperature increase in the hot portion of the development device 70 detected by the temperature sensor 118. This control operation can be executed by a controller 190 (see FIG. 5B) provided either in the cooling device 110 or the image forming section 100.

The control of the operation modes of the cooing fan 115*b* and the pump 111 is executed based on the highest detected temperature T (° C.) among the respective temperature sensor 118 as shown in Table 1. More specifically, as for the operation mode of the pump 111 as shown in Table 1, when the temperature (T) is equal to or lower than 35° C., the pump 111 is off (the pump 11 is not operated). When the temperature (T) is in a range of from 35° C. to 41° C., the pump 111 is operated at 50% duty (0.23 L/min). When the temperature (T) is higher than 41° C., the pump 111 is operated at a 100% duty (0.45 L/min). As for the cooling fan 115*b*, when the temperature (T) is equal to or lower than 38° C., the pump 111 is off (does not operate). When the temperature (T) is in a range of from 38° C. to 45° C., the cooling fan 115*b* is operated at 1500 rpm (rotation per moment). When the temperature (T) is higher than 45° C., the cooling fan 115*b* operated at 3000 rpm.

TABLE 1

| Detection temperature (T) | Pump 111 | Fan 115b |
|---|---|---|
| T ≤ 35° C. | Off | Off |
| 35° C. < T ≤ 38° C. | 50% duty (0.23 L/min) | Off |
| 38° C. < T ≤ 41° C. | 50% duty (0.23 L/min) | 1500 rpm |
| 41° C. < T ≤ 45° C. | 100% duty (0.45 L/min) | 1500 rpm |
| 45° C. < T | 100% duty (0.45 L/min) | 3000 rpm |

Thus, in the above-controlled cooling device 110, the operation modes of the cooling fan 115*b* and the pump 111 can be switched in accordance with the temperature in the hot portions of the respective development devices 70 detected by the temperature sensors 118. Accordingly, by switching the operation modes of the cooling fan 115*b* and the pump 111 in accordance with the detected temperature in the hot portions of the development devices 70, cooling operation can be executed with the minimum required energy. Therefore, waste of energy required for cooling can be eliminated by optimizing cooling ability, and the noise caused by driving the cooling fan 115*b* can be alleviated. Thus, cooling can be executed effectively in the cooling device 110 at low noise.

Second Embodiment

Next, a cooling device 110-1 according to a second embodiment is described below with reference to FIG. 10. In the present embodiment, differently from the cooling device 110 according to the first embodiment, a heat releaser 115-1 is set at another arrangement state. The common configuration and the operation therebetween are omitted below.

Figure 10:
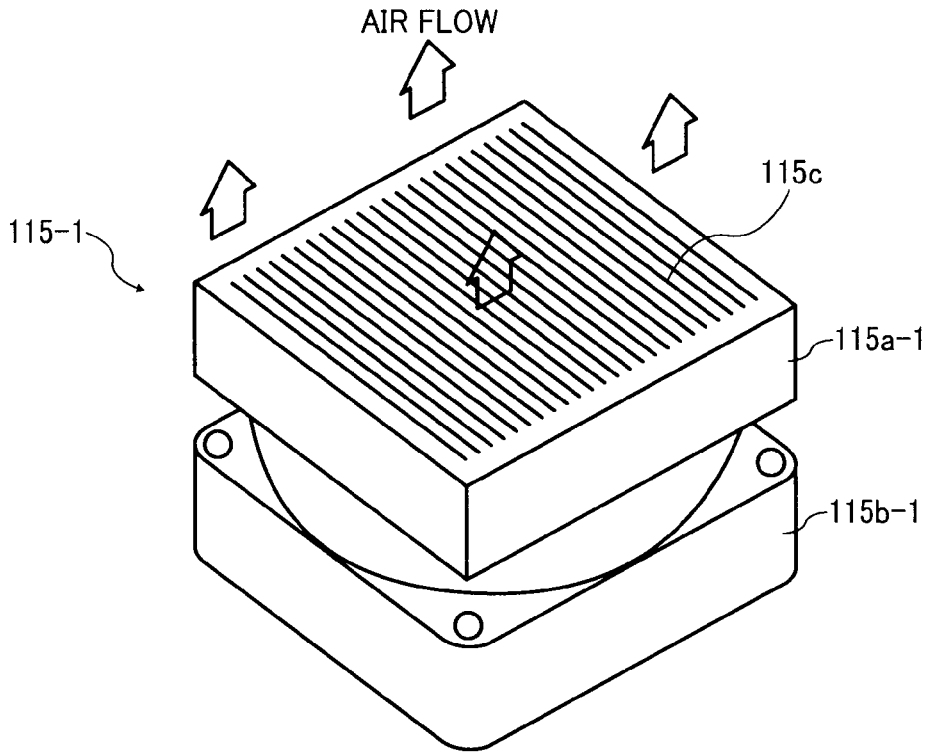
FIG. 10 is a diagram illustrating a heat releaser in a cooling device according to a second embodiment.

FIG. 10 is a diagram illustrating the heat releaser 115-1 in the cooling device 110-1. The heat releaser 115-1 is disposed so that intake and exhaust of the heat releaser 115-1 is set in a substantially vertical direction. A radiator 115*a*-1 according to the present embodiment includes multiple fins 115*c* arranged substantially parallel in a lateral direction. Air streaming is generated in the radiator 115-1 from an intake inlet to an exhaust outlet, and therefore the fins 115*c* release the heat. In the above-described first embodiment, the airflow is forcibly generated in a substantially horizontal direction by a cooling fan 115*b*-1, and therefore cooling is performed effectively. However, in a case in which the heat amount required for releasing is not so much, natural convection is enough for cooling.

In order to achieve a better result, in the heat releaser 115-1 of the second embodiment illustrated in FIG. 10, the radiator 115*a*-1 is disposed so that the air streaming from the intake inlet to the exhaust outlet is the vertical direction to release heat from the fin 115*c* of the radiator 115*a*-1 using natural convection. Thus, a certain amount of cooling effect can be obtained without driving the cooling fan 115*b*-1 of the heat releaser 115-1. In addition, cooling effect by natural convection is added to the cooling effect by driving the cooling fan 115*b*-1, and therefore, the operation mode of the cooling fan 115*b*-1 can be set at a lower mode.

For example, in a state in which the ambient temperature of the multifunction machine (image forming apparatus 1) is low and the heat amount required for releasing from the heat releaser 115-1 is small, sufficient cooling effect can be obtained when the operation mode of the cooling fan 115*b*-1 in the off mode, that is, a power off mode, so as not to rotate the cooling fan 115*b*-1. In a case in which heat cannot be released sufficiently in the power off mode of the cooling fan 115*b*-1 (using only natural convection), the cooling fan 115*b*-1 can be driven at slower operation mode (number of rotations of the cooling fan 115*b*-1 is set smaller) than a state in which natural convection is not used.

With this configuration of the cooling device 110-1, the heat can be released from the fin 115*c* of the radiator 115*a*-1 by the air stream caused by natural convection, the certain amount of cooling effect can be obtained even when the cooling fan 115*b*-1 of the heat releaser 115-1 is off state (power off mode so as not to rotate the cooling fan 115*b*-1). In addition, the cooling effect by the natural convection is added to the cooling effect by driving the cooling fan 115*b*-1, the operation mode of the cooling fan 115*b*-1 can be set lower mode that the number of rotations of the cooling fan 115*b*-1 is lower. Thus, in the above-controlled cooling device 110-1, the operation modes of the cooling fan 115*b*-1 and the pump 111-1 can be switched in accordance with the temperature in the hot portions of the respective development devices 70 detected by the temperature sensors 118. Accordingly, by switching the operation modes of the cooling fan 115*b*-1 and the pump 111-1 in accordance with the detected temperature in the hot portions of the development devices 70, cooling operation can be executed with the minimum required energy. Therefore, waste of energy required for cooling can be more eliminated by optimizing cooling ability, and the noise caused by driving the cooling fan 115*b*-1 can be alleviated. Thus, cooling can be executed more effectively in the cooling device 110-1 at low noise.

Third Embodiment

Figure 11:
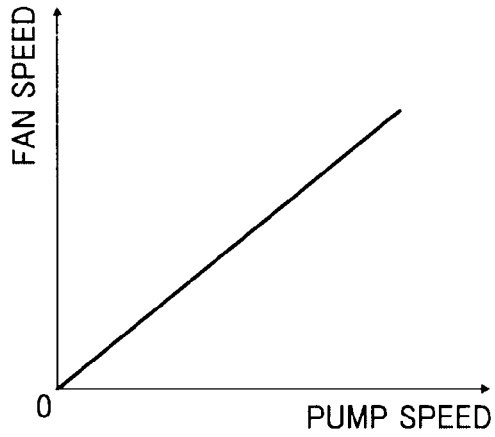
FIG. 11 shows a relation between a coolant flow rate of a pump and a number of rotations of a cooling fan in a cooling device according to a third embodiment.

Next, a cooling device 110-2 according to a third embodiment is described below with reference to FIG. 11. Differing from the above-described embodiments, in the cooling device 110-2 according to the third embodiment, an operation mode of a pump 111-2 is switched in conjunction with an operation mode of a cooling fan 115*b*-2 so that number of rotations of the cooling fan 115*b*-2 is proportional to a coolant flow rate of the pump 111-2. The description of the common configuration and operation is omitted.

In general, in the cooling device using a radiator installed in a heat releaser, amount of heat release in the heat releaser does not exceed the heat amount that can transmit to the coolant fed by a pump. In other words, a cooling fan in the radiator is just a device to effectively release the heat transmitted to the coolant, and an absolute value of the amount of heat release uniquely depends on the coolant flow rate of the pump.

Therefore, in the cooling device 110-2 of the present embodiment, when the respective operation modes of the cooling fan 115*b*-2 and the pump 111-2 are changed in accordance with the temperature in the hot portions of the development device 70 detected by the temperature sensor 118, the change of the respective operation modes of the cooling fan 115*b*-2 and the pump 111-2 as follows.

Initially, the operation mode of the pump 111-2 is changed in accordance with the temperature detected by the temperature sensor 118, and the operation mode of the cooling fan 115*b*-2 is changed in conjunction with switching the operation mode of the pump 111-2 proportionally. Herein, "proportionally" means identically, that is, a relation such that, for example, an increase in the operation mode of the pump 111-2 from step 1 to step 3 on a scale of one to ten is accompanied by an identical increase the operation mode of the cooling fan 115*b*-2 from step 1 to step 3 on a scale of one to ten in proportion to the operation mode of the pump 111-2. Namely, in the cooling device 110-2, the operation modes of the pump 111-2 and the cooling fan 115*b*-2 may be changed equivalently. With this configuration, the heat transmitted to the coolant C from the hot portion of the development device 70 can be cooled by releasing effectively from a radiator 115*a*-2 of the heat releaser 115-2. Herein, in the cooling device 110-2, by having numerous steps for the cooling fan 115-2 and the pump 111-2, the speed of the fan and the pump can be changed substantially continuously. More specifically, in a graph illustrated in FIG. 8, by changing the number of rotations of the cooling fan 115*b*-2 in the heat releaser 115-2 (fan speed) depending on the coolant flow rate of the pump 111-2 (pump speed), the heat in the coolant C transmitted from the hot portion of the development device 70 is effectively released, and the hot portion of the development device 70 is cooled.

Thus, since the cooling device 110-2 is controlled as described above, the coolant flow rate is adjusted in accordance with the temperature in the hot portion of the development device 70, which prevents unnecessary energy from consuming. Then, by controlling the number of rotations of the cooling fan 115*b*-2 in the heat releaser 115-2 proportional to the coolant flow rate of the pump 111-2, the cooling ability in the cooling device 110-2 can be optimized. Thus, in the above-controlled cooling device 110-2, the operation modes of the cooling fan 115*b*-2 and the pump 111-2 can be switched in accordance with the temperature in the hot portions of the respective development devices 70 detected by the temperature sensors 118. Accordingly, by switching the operation modes of the cooling fan 115*b*-2 and the pump 111-2 in accordance with the detected temperature in the hot portions of the development devices 70, cooling operation can be executed with the minimum required energy. Therefore, waste of energy required for cooling can be more eliminated by optimizing cooling ability, and the noise caused by driving the cooling fan 115*b*-2 can be alleviated. Thus, cooling can be executed more effectively in the cooling device 110-2 at low noise.

As described above, the control system of the first through third embodiments are adapted for the cooling device 110 including the coolant circulation system 120 formed by annular connection among the heat receiver 112 provided for respective colors, the pump 111, the radiator 115*a* (115*a*-1, 115*a*-2) of the heat releaser 115 (115-1, 115-2), and the tank 113. That is, in the above described cooling configuration, the hot portions of the development devices 70Y, 70M, 70C, and 70Bk are cooled by single common cooling device 110 formed by the coolant circulation system 120. However, the cooling control system of the above-described embodiments is not limited to the above-described cooling configuration; for example, the cooling control system of the above-described embodiments can be used for four independent cooling devices corresponding to the hot portions of the development devices 70Y, 70M, 70C, and 70Bk. In this case, the respective independent cooling devices control the corresponding pumps and the cooling fans in accordance with the detection results of the temperature sensors in the respective but portions, and therefore, the configuration of the independent cooling device can achieve functions and effects similar to those of the common cooling device described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A cooling device to cool an apparatus, the cooling device comprising:

a heat receiver to receive heat from a hot portion of the apparatus using a coolant while contacting the hot portion of the apparatus;

a heat releaser to cool the heat-received coolant to release the heat from the hot portion of the apparatus to outside the apparatus, the heat releaser having a variable-speed fan of multiple operation speed modes including an off mode;

a coolant circulation system through which the coolant is circulated between the heat receiver and the heat releaser;

a variable-speed pump to move the coolant through the coolant circulation system, whose operation speed modes include an off mode and relate to a coolant flow rate of the pump;

a temperature sensor to detect a temperature in the hot portion, the temperature sensor being located within the heat receiver; and a controller to control the operation modes of the fan and the pump in accordance with the temperature detected by the temperature sensor.

2. The cooling device according to claim 1, wherein the heat releaser is disposed so that cooling is performed by natural convection.

3. The cooling device according to claim 2, wherein intake and exhaust of the heat releaser are disposed in a substantially vertical direction to cool the coolant using natural convection.

4. The cooling device according to claim 1, wherein the operation modes of the pump and the fan are changed proportionally.

5. The cooling device according to claim 1, wherein the operation modes of the pump and the fan are changed equivalently.

6. A cooling method used in a cooling device,
the cooling method comprising:
contacting a heat receiver with an external hot portion;
receiving heat by the heat receiver from the hot portion using a coolant;
detecting a temperature in the hot portion with a temperature sensor, the temperature sensor being located within the heat receiver;
pumping a coolant from the heat receiver through a coolant circulation system to a variable-speed pump;
switching a speed of the pump in accordance with the temperature detected by the temperature sensor;
pumping the coolant from the pump through the coolant circulation system to a heat releaser;
switching a speed of a variable-speed fan in the heat releaser in accordance with the temperature detected by the temperature sensor;
cooling the coolant by the heat releaser;
pumping the cooled coolant from the heat releaser through the coolant circulation system to the heat receiver; and
releasing the heat from the hot portion to outside the cooling device using the cooled coolant.

7. The cooling method according to claim 6, further comprising:
generating airflow with external air taken into the heat releaser; and
cooling the coolant by using natural convection in the heat releaser.

8. The cooling method according to claim 7, wherein intake and exhaust of the heat releaser are disposed in a substantially vertical direction to cool the coolant using natural convection.

9. The cooling method according to claim 6, wherein the speeds of the pump and the fan are changed proportionally.

10. The cooling method according to claim 6, wherein the speeds of the pump and the fan are changed equivalently.

11. An image forming apparatus comprising:
a latent image carrier to carry a latent image;
a development device to develop the latent image formed on the latent image carrier with developer, the development device being removably installed in the image forming apparatus;
a cooling device to cool the development device,
the cooling device comprising:
a heat receiver to receive heat from a hot portion of the development device using a coolant while contacting the hot portion of the development device;
a heat releaser to cool the heat-received coolant to release the heat from the hot portion of the development device to outside the image forming apparatus, the heat releaser having a variable-speed fan of multiple operation speed modes including an off mode;
a coolant circulation system through which the coolant is circulated between the heat receiver and the heat releaser;
a variable-speed pump to move the coolant through the coolant circulation system, whose operation speed modes include an off mode and relate to a coolant flow rate of the pump; and
a temperature sensor to detect a temperature in the hot portion, the temperature sensor being located within the heat receiver; and
a controller to control the operation modes of the fan and the pump in the cooling device in accordance with the temperature detected by the temperature sensor.

12. The cooling device according to claim 1, wherein the temperature sensor is positioned away from the coolant circulation system in the heat receiver.

* * * * *